United States Patent [19]

Cline

[11] Patent Number: 5,048,242

[45] Date of Patent: Sep. 17, 1991

[54] ACCESS FLOOR SYSTEM WITH HEMMED EDGE PANEL

[75] Inventor: Steven D. Cline, Hastings, Mich.

[73] Assignee: C-Tec, Inc., Grand Rapids, Mich.

[21] Appl. No.: 504,291

[22] Filed: Apr. 4, 1990

[51] Int. Cl.[5] ..... E04B 5/57

[52] U.S. Cl. ..... 52/126.6; 52/263

[58] Field of Search ..... 52/126.3, 126.6, 263, 52/716, 792, 731, 126.5, 793, 630

[56] References Cited

U.S. PATENT DOCUMENTS

| | | | |
|---|---|---|---|
| 2,194,421 | 3/1940 | DeSaussure, Jr. . | |
| 2,205,363 | 6/1940 | Kral . | |
| 2,278,331 | 3/1942 | Meyercord . | |
| 2,605,157 | 7/1952 | Reitzel . | |
| 2,729,142 | 1/1956 | Beach, Jr. . | |
| 2,956,653 | 10/1969 | Liskey | 52/126.6 |
| 3,077,012 | 2/1963 | Speraw . | |
| 3,150,748 | 9/1964 | Liskey | 52/301 |
| 3,222,030 | 12/1965 | Thorpe . | |
| 3,236,018 | 2/1966 | Graham et al. . | |
| 3,318,057 | 5/1967 | Norsworthy | 52/126.6 |
| 3,380,217 | 4/1968 | Mikus | 52/630 |
| 3,396,501 | 8/1968 | Tate . | |
| 3,667,071 | 6/1972 | Hoch et al. . | |
| 3,759,005 | 9/1973 | Smith | 52/403 |
| 3,900,995 | 8/1975 | Ehrenberg | 52/126.6 |
| 4,035,967 | 7/1977 | Harvey | 52/263 |
| 4,068,444 | 1/1978 | Ollinger | 52/731 |
| 4,142,341 | 3/1979 | Mott | 52/263 |
| 4,279,109 | 7/1981 | Madl, Jr. | 52/263 |
| 4,295,319 | 10/1981 | Griffin | 52/785 |
| 4,319,520 | 3/1982 | Lanting et al. | 52/126.6 |
| 4,447,998 | 5/1984 | Griffin | 52/126.6 |
| 4,453,365 | 6/1984 | Gladden | 52/716 |
| 4,461,131 | 7/1984 | Pressell | 52/395 |
| 4,548,843 | 10/1985 | Kozuka et al. | 428/31 |
| 4,570,383 | 2/1986 | Adell | 52/716 |
| 4,574,555 | 3/1986 | Cline | 52/263 |
| 4,578,910 | 4/1986 | Germeroth et al. | 52/126.6 |
| 4,606,156 | 8/1986 | Sweers et al. | 52/126.6 |
| 4,621,468 | 11/1986 | Likozar | 52/126.6 |
| 4,625,491 | 12/1986 | Gibson | 52/126.6 |
| 4,637,181 | 1/1987 | Cohen | 52/126.5 |
| 4,850,176 | 7/1989 | Munsey et al. | 52/829 |
| 4,856,256 | 8/1989 | Tokuzo | 52/792 |
| 4,922,670 | 5/1990 | Naka et al. | 52/126.6 |

FOREIGN PATENT DOCUMENTS

| | | | |
|---|---|---|---|
| 858417 | 11/1940 | France . | |
| 1397939 | 12/1965 | France . | |
| 1358454 | 10/1967 | France . | |
| 452163 | 5/1968 | Switzerland . | |
| 561214 | 5/1944 | United Kingdom | 52/793 |
| 753807 | 8/1956 | United Kingdom . | |

OTHER PUBLICATIONS

C-Tec brochure entitled "A New Horizon In Access Flooring", 1984.

*Primary Examiner*—James L. Ridgill, Jr.
*Attorney, Agent, or Firm*—Price, Heneveld, Cooper, DeWitt & Litton

[57] ABSTRACT

An access floor system includes a plurality of floor panels, each panel having a pan and a cooperating top plate. The top plate is folded over a peripheral flange of the pan to define a hemmed edge. A trim piece is configured to snap over the hemmed edge of the floor panel. A support pedestal assembly includes a support plate configured to support the floor panels at their corners. Generally T-shaped stringers are joined to the support plates in a grid-like pattern. The stringers are rigidly connected to the plates or snap-on to lock tabs defined by the plates.

15 Claims, 3 Drawing Sheets

ACCESS FLOOR SYSTEM WITH HEMMED EDGE PANEL

BACKGROUND OF THE INVENTION

The present invention relates to access floor systems and more particularly to an access floor panel and support substructure.

A wide variety of access floor systems have previously been developed. The floor systems provide a functional floor elevated above a structural or subfloor of a building. The systems provide a means for easily installing and subsequently accessing power and communication cables required in various environments including compute installations. The systems also permit heating, cooling and ventilation equipment and distribution systems to be conveniently located and accessed beneath the functional floor.

A typical access floor system includes a plurality of generally rectangular floor panels. The panels are supported at their four corners on pedestal subassemblies which rest on the structural subfloor. The panels may be of several different constructions. Typical panels include a lower plate or pan which contains a core material. The core material may be a light weight, high-strength concrete mixture or a high density wood particle core. The floor panels may include a top plate which may be covered or finished with carpeting, conductive vinyl, vinyl asbestos, tile or high pressure plastic laminates, for example. In addition, a peripheral trim may be applied to the edges of the panel. The trim is generally included for aesthetic reasons. The trim may, for example, frame a carpet square and protect the carpet edge from unraveling. Trim pieces also eliminate gaps between the finished covering and the perimeter of the pan structure.

In many installations, a rigid gridwork may be provided which supports the pans along their edges. The gridwork is defined by a plurality of elongated stringers which are connected at their ends to the pedestal subassemblies. Examples of prior access floor panels and systems may be found in commonly owned U.S. Pat. No. 4,606,156 entitled ACCESS FLOORING PANEL which issued on Aug. 19, 1986 to Sweers et al and commonly owned U.S. Pat. No. 4,850,176 entitled ACCESS FLOOR PANEL WITH PERIPHERAL TRIM which issued on July 25, 1989 to Munsey et al.

Various problems have been encountered with some of the prior systems. Problems have been experienced, for example, with obtaining adequate strength and accurate finish panel dimensions. Prior trim pieces have generally been fabricated from vinyl extrusions. Problems have been experienced with retaining the trim pieces on the panels and accommodating different panel covering selections. Prior support systems have not readily accommodated different panel configurations and have suffered from installation problems.

SUMMARY OF THE INVENTION

In accordance with the present invention, the aforementioned problems are substantially alleviated. Essentially, a floor panel for an access floor system is provided which includes a pan or lower plate having sidewalls terminating in a generally horizontally extending peripheral flange. A top plate is juxtaposed on the pan. The top plate has a peripheral edge portion which is folded over the flange of the lower pan to define a hemmed edge. The hemmed edge configuration significantly increases the edge strength of the panel and results in more accurate panel dimensions than prior laminated panels. The overlap of the top and bottom sheets permits the parts to have greater dimensional variances without having an adverse effect on the finished parts dimension tolerances or quality. Fixtures and assembly processes are hence substantially easier than those previously experienced.

The hemmed edge configuration of the panel readily receives and retains a trim piece in accordance with the present invention. The trim piece has a generally C-shape or U-shape in cross section and defines an upstanding closure portion dimensioned to snap over and capture the hemmed edge. The trim piece may be made in a variety of colors and thicknesses to easily accommodate different panel covering selections.

In narrower aspects of the invention, the system includes a floor support subassembly including a plurality of pedestal subassemblies and a plurality of stringers. The stringers may support the panel edge either at a top or bottom of the stringer section. The pedestal subassemblies and stringers are configured to permit snap on assembly of the stringers reducing installation costs and increasing the ease of assembly.

DETAILED DESCRIPTION OF THE PREFERRED EMBODIMENTS

Figure 1:
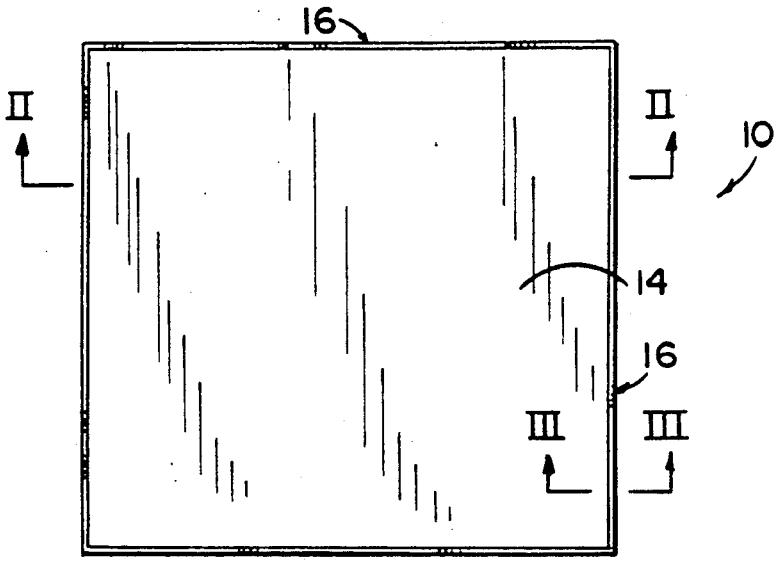
FIG. 1 is a top, plan view of an access floor panel in accordance with the present invention.
Figure 2:
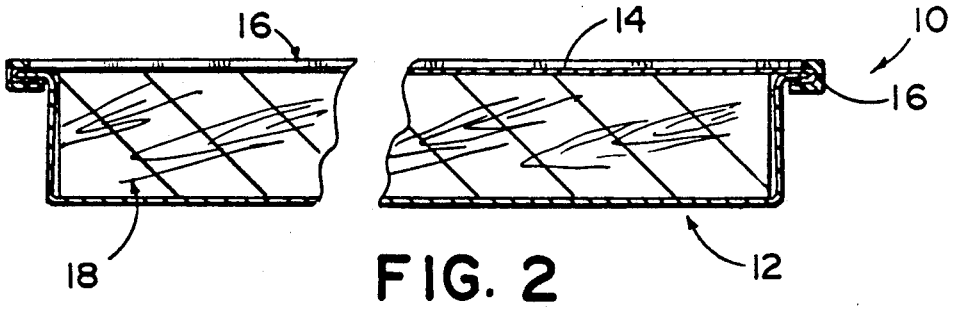
FIG. 2 is a fragmentary, cross sectional view taken generally along line II—II of FIG. 1.
Figure 3:
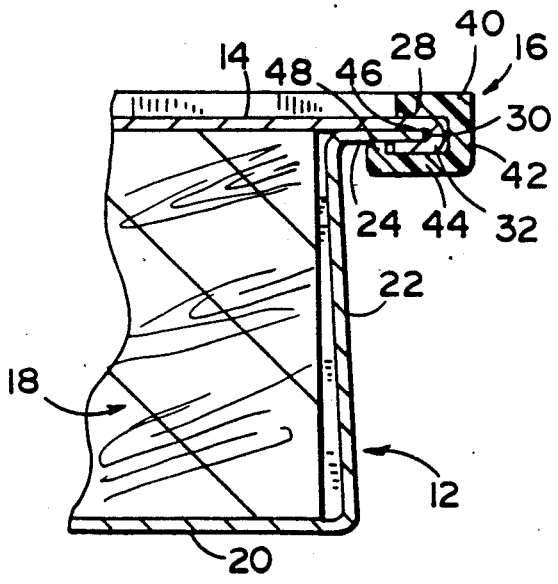
FIG. 3 is an enlarged, fragmentary, cross sectional view taken generally along line III—III of FIG. 1.

An access floor panel in accordance with the present invention is illustrated in FIGS. 1–3 and generally designated by the numeral 10. Panel 10 includes a lower plate or pan 12, an upper plate 14 and a plurality of trim pieces 16. Pan 12 includes a bottom 20 and sidewalls 22 joined to the bottom. Sidewalls 22 terminate and upper edge portions which are bent outwardly to define horizontally extending flanges 24. The interior of pan 12 is filled with a core 18. Core 18 may be a light weight, high-strength concrete mix which is poured directly into the pan and allowed to set. In the alternative, the core may be a high density wood particle core which is structurally bonded to pan bottom 20 and top plate 14.

Upper plate 14 is positioned on or juxtaposed on pan 12. As best seen in FIG. 3, top plate 14 includes peripheral portions 28. Portions 28 are folded over and bent around outer peripheral edges 30 of horizontal flanges 24. Top plate portions 28, therefore, include a reverse bent portion 32. Portions 28 define a hemmed edge. The hemmed edge or folded over configuration of the plates increase the strength and rigidity of the peripheral edges of the panel lo. The hemmed configuration reduces the criticality of the dimensional tolerances of the top plate 14 and the pan 12. Accurate dimensioning of the assembled pan is readily achieved by folding over portions 28. In addition, the plate portions 28 could be welded or otherwise bonded to the flanges 24. The direct contact between plate 14 and pan 12 eliminates the need for separate ground wires to electrically connect theses members. Prior wood core, laminated panels required such to dissipate static electricity. The assembly and manufacture of the panel is simplified while maintaining product quality. With the exception of the horizontal edge portion 28 and the overlap or hemmed configuration of the top plate, the basic pan construction is more fully described in commonly owned U.S. Pat. No. 4,606,156. To the extent necessary, the disclosure of such patent is hereby incorporated by reference.

As seen in FIGS. 2 and 3, peripheral trim piece 16 is mechanically locked on to the hemmed edge portion 28 of pan 10. In the presently preferred form, trim piece 16 is an elongated, vinyl extrusion having a generally U-shape in vertical cross section. Extrusion or trim piece 16 includes an upper leg 40, a base 42 and a lower leg 44. Piece 16 defines an open channel 46. Channel 46 is partially closed by an upwardly extending tab, closure or stop portion 48. Stop 48 is formed integral with lower leg 44. Trim piece 16 is readily snapped or press fitted onto the hemmed edge of the panel. When snapped on, stop 48 is opposite and opposed by portion 32 of top plate 14. Removal of trim piece 16 from panel 10 is, therefore, prevented or restricted. The hemmed edge configuration of the panel permits use of a trim piece having a simplified configuration and which cooperates with the hemmed edge for retention. The trim piece is more easily assembled than prior approaches. Trim piece 16 may be made in different colors and thicknesses to more easily accommodate coverings which may be positioned on top of plate 14. The top of the panel may be covered with carpet, conductive vinyl, vinyl asbestos tile or other suitable materials as is known in the art. Trim piece 16 improves the aesthetics of the system and protects the panel covering.

Figure 6:
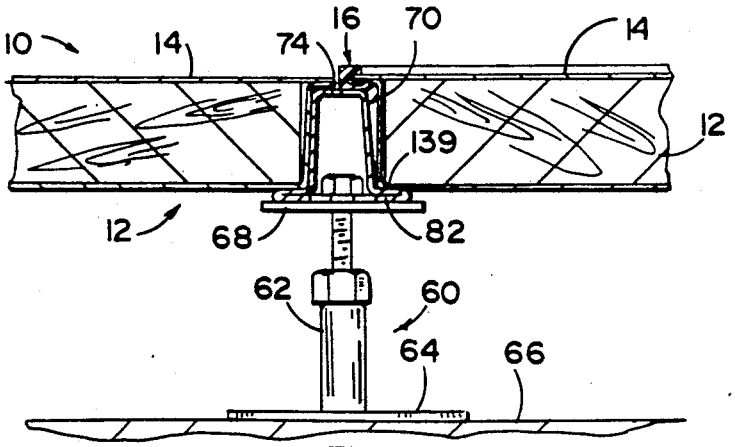
FIG. 6 is a fragmentary, side elevational view of a access floor system in accordance with the present invention.

A plurality of panels 10 are supported on pedestal subassemblies 60 (FIG. 6). Each pedestal 60 includes a vertical support post 62 and a foot 64. Foot 64 rests on a subfloor 66. Individual panels 10 are supported at their corners by a support plate 68. Plate 68 is vertically adjustable on pedestal 62. Many installations will not, however, require the gridwork. The panels may merely rest on the pedestal subassemblies. Also, as disclosed in the aforementioned U.S. Pat. No. 4,606,156, the panels may be bolted directly to the plates 68.

Figure 9:
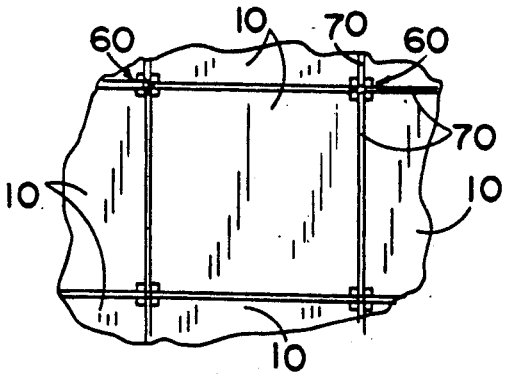
FIG. 9 is a fragmentary, top plan view of an access floor system and substructure in accordance with the present invention.

As seen in FIG. 9, each pedestal subassembly 60 may be interconnected by a plurality of elongated stringers 70. Stringers 70 define a rectangular gridwork which receives and supports individual panels 10. Each pedestal subassembly may support four panels 10 at their adjacent corners.

Figure 4:
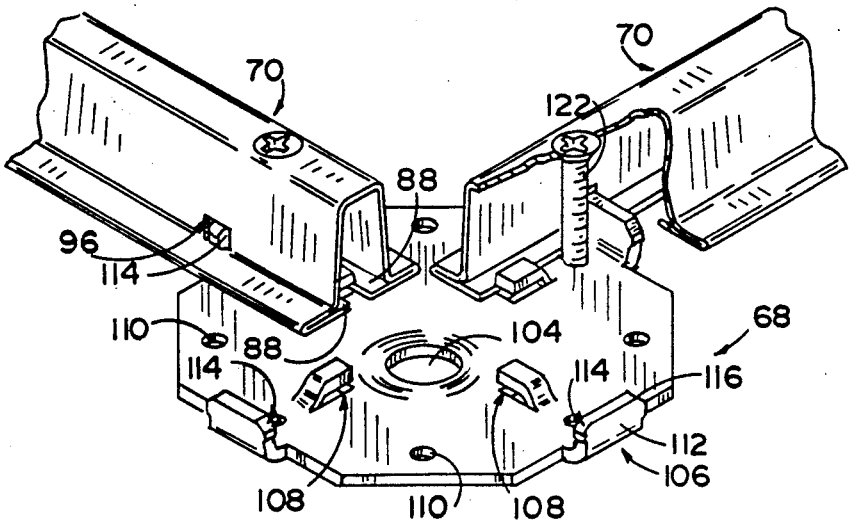
FIG. 4 is a fragmentary, perspective view showing a rigid interconnection between a support plate and a pair of stringers in accordance with the present invention.
Figure 5:
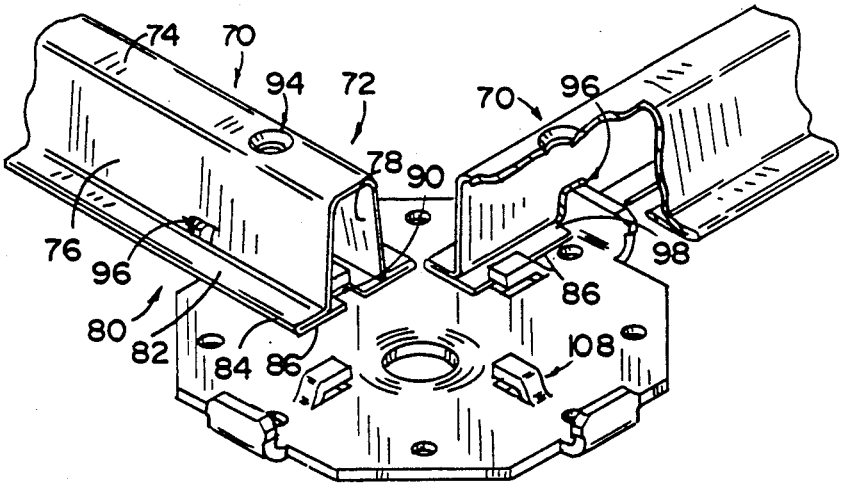
FIG. 5 is a fragmentary, perspective view showing a support plate and a pair of stringers in a snap on configuration.

A support plate and stringer subassembly in accordance with the present invention is best seen in FIGS. 4 and 5. As shown therein, stringers 70 have a generally T-configuration in cross section. The stringers includes a leg portion 72 having a generally planar base 74 and sides 76, 78. Sides 76, 78 each terminate in flange portions 80. Flanges 80 include outwardly extending portions 82 which are reverse bent or folded at lateral edges 84 to form inwardly extending horizontal flanges 86. Flange portions 80, therefore, have opposed, inner, lateral edges 88 which define an elongated, centrally extending slot 90. Each stringer 70, at its ends, defines bolt apertures 94. Sidewalls 76, 78 of the stringers also define opposed lock apertures 96.

Support plates 68 include a central mounting aperture 104 and upwardly extending, equally spaced lock tabs 106. In the form illustrated, plate 68 has a regular octagonal configuration in top plan. Plate 68 further defines a plurality of upwardly extending, lanced alignment tabs 108 and bolt apertures 110. Lock tabs 106 each include a base portion 112 and outwardly extending ears 114. Each ear includes an upper, downwardly and outwardly angle or beveled cam surface 116. Each of the inwardly extending flange portions 86 of the stringers 70 define opposed, transversely extending slits 98. Slits 98 extend inwardly towards each other at lock apertures 96.

The assembly of stringers 70 onto support plates 68 is illustrated in FIGS. 4 and 5. The stringers are initially aligned with one of the alignment tabs 108 with the tab received within slot 90. The stringers may then be pressed downwardly. Lock tabs 106 are received within slits 98 and walls 76 of the stringers will cam outwardly on surfaces 116 until locking ears 114 snap into lock apertures 96. During the initial assembly, bolt holes 94 provide positioning control. The snap on mounting of the stringers is illustrated in FIG. 5. Should a rigid grid construction be desired, bolts 122 (FIG. 4) are positioned through apertures 94 in stringer 70 and bolt apertures 110 in plate 68.

Figure 7:
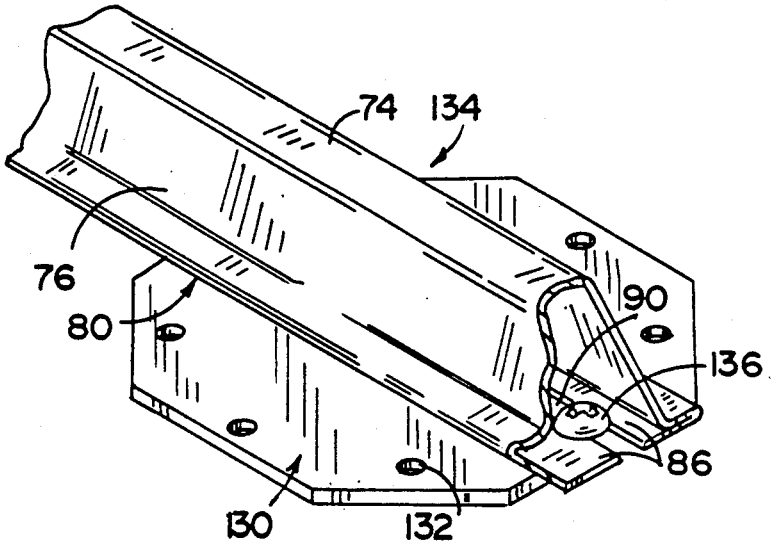
FIG. 7 is a fragmentary, perspective view of a perimeter support plate and stringer.

A perimeter stringer and plate arrangement is illustrated in FIG. 7. As shown therein, a support plate 130 is provided with a plurality of bolt or fastener apertures 132. A perimeter stringer 134 is secured to plate 130 by fasteners 136 which engage inwardly turned flanges 86 and extend through elongated slot 90. Perimeter stringers 134 are of the same configuration as stringers 70. Bolt apertures 94 and lock apertures 96 may, however, be eliminated. Stringers 134 ar used around the perimeter of the room within which the raised access floor system is installed.

In use, the gridwork defined by the pedestal subassemblies 60 and stringers is positioned on the subfloor of the building. Stringers 70 may be rigidly connected to their respective support plates 68 or merely snapped-on to define the grid structure. Next, individual panels 10 are laid on to the gridwork. The system, as seen in FIG. 6, provides triple support for the panels. Each panel is supported at its corners on plates 68. The hemmed edges are supported on base portions 74 of the stringers. Finally, bottom portions 39 of the pans at the sidewalls are supported on flanges 80 of the stringers.

Trim pieces 16 as shown in FIG. 6 will abut against trim pieces of adjacent panels. The trim pieces 16 prevent metal to metal contact thereby reducing noise which may be associated with deflection of the panels. Pieces 16 also enhance the aesthetics and appearance of the overall flooring system. As seen in FIG. 6, stringers 70 nest with the hemmed edges of the panel. The substructure in accordance with the present invention, permits the hemmed edges of the panels to rest on the bases 74, as shown in FIG. 6. In the alternative, the stringers and support pedestal subassemblies may be positioned so that the hemmed edges rest on the top surfaces of flange portions 80. In this configuration, panels 10 would include a covered top surface which would extend up to the edges or base of the stringers. The substructure in accordance with the present invention, therefore, readily accommodates different panel configurations and coverings.

Figure 8:
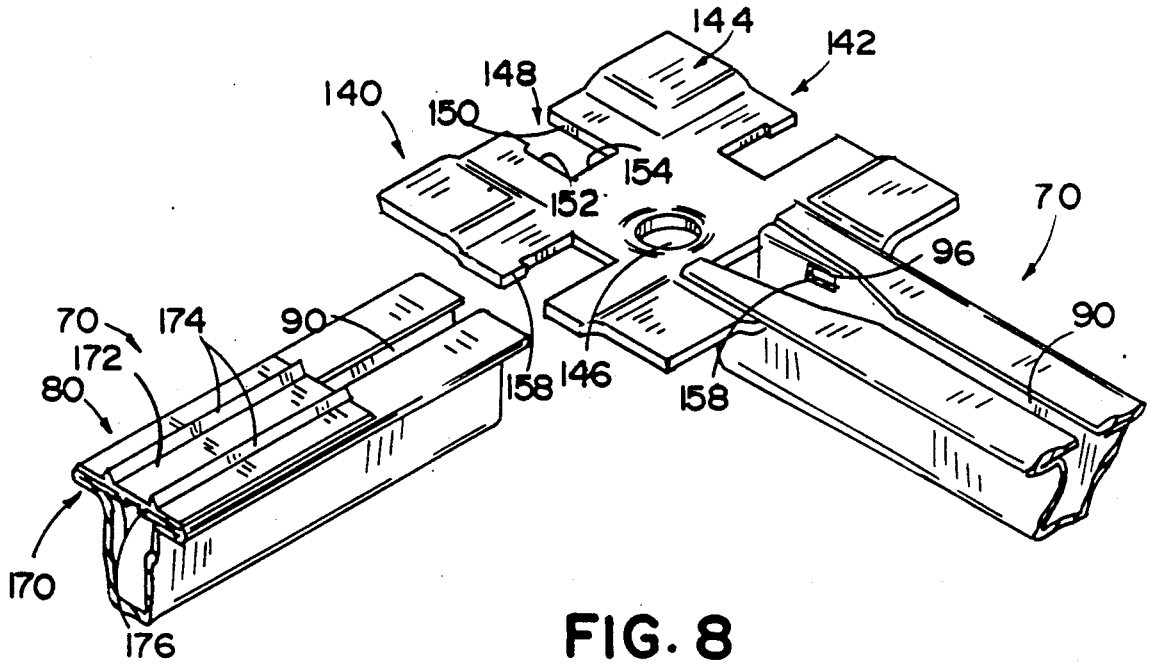
FIG. 8 is a perspective view of an alternative stringer and support plate in accordance with the present invention.

An alternative stringer and support plate subassembly is illustrated in FIG. 8 and generally designated by the numeral 140. Alternative 140 includes a support plate 142 which is generally square in top plan and defines four, corner portions 144. A center portion of plate 142 defines a bolt or mounting aperture 146. Plate 142 further defines four outwardly opening slots 148. Slots 148 are dimensioned to receive stringers 70 and each includes opposed sides 150, 152 and a base 154. The stringers are inserted within the slots in an inverted position with flange portions 80 resting on the flat surfaces adjacent slots 148.

Plate 142 defines a lock tabs 158 which extend into slots 148 at their open edges. Tab 158 snaps into a lock aperture 96 formed in a sidewall or side of stringer 70.

In the inverted arrangement as shown in FIG. 8, individual floor panels 10 may be supported along their lateral edges by the flanges 80 of stringers 70. The elongated slots 90 of the stringers readily receive and retain a panel positioner 170. Positioner 170 is an elongated, member preferably formed as a vinyl extrusion. Positioner 70 includes a generally planar portion 172. Positioning flanges or legs 174 extend upwardly from portion 172 in spaced, opposed, parallel relationship. Retaining legs or flanges 176 extend downwardly from portion 172. The retaining flanges are spaced apart a distance substantially equal to the width of slot 90. The retaining portions positively locate and retain the positioners on the stringer system. Heretofore, such positioners where not retained in place and were easily knocked off during installation. Legs or flanges 174 define the positions against which lateral edges of panels 10 abut.

In the presently preferred embodiment of the access floor system in accordance with the present invention, the pans or lower plates 12 are fabricated from CRCQ paint grip galvanized steel having a thickness in the range of 0.025 to 0.030 inches. Top plate or sheet 14 is fabricated from a 0.025 inch thick CRCQ electro galvanized steel. The hemmed edge construction permits the use of a relatively soft steel for the top plate or sheet with significant edge strength provided by the hemmed configuration. Trim strips 16 are preferably extruded from a rigid vinyl material in the uninstalled configuration, lower leg 44 angles upwardly towards upper leg 40 at an angle of approximately 6°-8°. The angling of the lower leg improves the snap fit onto the hemmed edge thereby improving the retention reliability.

The access floor panel and floor system in accordance with the present invention increases the ease of manufacture of the panel by reducing the criticality in manufacturing tolerances. Accurate finished panel dimensioning and quality are achieved. The invention permits greater variance in the dimensions of the individual components. The fixturing and assembly processes are significantly easier than those used with prior approaches. The hemmed edge configuration increases strength and permits a simple extrusion to be employed as a trim piece. The trim piece is retained in a positive fashion by snapping over the edge. The vinyl extrusions may be made in various dimensions and colors to accommodate different coverings for the individual floor panels. The understructure of the floor system provides increased versatility and ease of assembly. The stringers readily accommodate bare or covered panels. The understructure provides support along the lateral edges of the panel and resist deflection when the system is loaded. The stringers may be nested within the space defined by opposed edges or sides of adjacent panels. The stringer configuration readily accommodates an extruded positioner providing positive location and retention.

In view of the above description, those of ordinary skill in the art may envision various modifications which would not depart from the inventive concepts disclosed herein. It is expressly intended, therefore, that the above should be considered as only the description of the preferred embodiments. The true spirit and scope of the present invention may be determined by reference to the appended claims.

The embodiments of the invention in which an exclusive property or privilege is claimed are defined as follows:

1. An access floor system, comprising:

a plurality of floor panels, each panel including a pan having a bottom, a sidewall, and a generally horizontally extending peripheral flange joined to said sidewall;

a top plate juxtaposed on said pan, said top plate including a peripheral portion which is configured to extend around and under said flange of said sidewall pan to define a hemmed edge;

a plurality of support pedestal assemblies, each assembly including a support plate configured to support said floor panels at their corners; and a plurality of elongated trim pieces positioned on the hemmed edge, each of said trim pieces being generally U-shaped in cross section and each including an upper leg, a base and a lower leg, said legs being joined to said base with each leg including a free end, and wherein the free end of said lower leg defines an upstanding portion dimensioned to snap over and capture said hemmed edge.

2. An access floor system as defined by claim 1 wherein each of said stringers is generally T-shaped in cross section including an elongated generally U-shaped leg portion defined by a base and sides, said sides terminating in outwardly extending, generally horizontal flanges, said stringers thereby each defining an elongated slot and wherein each of said support plates defines a plurality of outwardly opening plate slots, each plate slot dimensioned to receive a leg portion of one of said stringers.

3. An access floor system as defined by claim 2 wherein each of said stringers defines a lock aperture and wherein said plates define a plurality of lock tabs, each lock tab extending into one of said plate slots and being received in one of said lock apertures.

4. An access floor system as defined by claim 2 further comprising a plurality of elongated panel positioners, each positioner including upstanding positioning flanges positioned to engage and locate panels on the stringers and a depending retainer extending into said slot of said stringer for retaining the positioner on said panel.

5. An access floor system as defined by claim 1 further including a plurality of elongated stringers, said stringers extending between said pedestal assemblies to define a gridwork, each of said stringers being generally T-shaped in cross section including an elongated generally U-shaped leg portion defined by a base and sides, said sides terminating in outwardly extending, generally horizontal flanges, said stringers thereby each defining an elongated slot, said support plate of each pedestal assembly defining a plurality of upstanding lock tabs dimensioned to extend through said slots of said stringers, and wherein each of said stringers defines a lock aperture in one of said sides of said stringer and wherein each lock tab defines an ear dimensioned to extend into said lock aperture.

6. An access floor system as defined by claim 5 wherein said horizontal flanges of said stringers are folded back into themselves so as to extend back towards each other to thereby define said slot.

7. An access floor system as defined by claim 6 wherein each of said support plates defines a plurality of alignment tabs, each tab being in-line with one of said lock tabs.

8. An access floor system as defined by claim 7 wherein said horizontal flanges of said stringers define traverse slots at said lock aperture dimensioned to receive said lock tab.

9. An access floor system as defined by claim 8 wherein each of said lock tabs defines a pair of ears, each ear having a downwardly angled upper edge which defines a camming surface so that said stringers may be snapped into said support plates with said ears camming said sides of said stringers open to receive said lock tabs.

10. A support pedestal and stringer subassembly for supporting a plurality of raised access floor panels, said subassembly comprising:

a base adapted to rest on a subfloor;

a support plate on said base; and a plurality of elongated stringers, each of said stringers being generally T-shaped in cross section and including an elongated generally U-shaped leg portion defined by a base and sides, said sides terminating in outwardly extending, generally horizontal flanges, said stringers thereby each defining an elongated slot, said support plate defining a plurality of upstanding lock tabs dimensioned to extend through said slots of said stringers, each of said stringers defines a lock aperture in one of said sides of said stringer and wherein each lock tab defines an ear dimensioned to extend into one of said lock apertures, and wherein each of said support plates defines a plurality of alignment tabs, each tab being in-line with one of said lock tabs.

11. A subassembly as defined in claim 10 wherein said horizontal flanges of said stringers are folded back into themselves so as to extend back towards each other to thereby define said slot.

12. A subassembly as defined by claim 11 wherein said horizontal flanges of said stringers defines a traverse slot at said lock aperture dimensioned to receive said lock tab.

13. A subassembly as defined by claim 12 wherein each of said lock tabs defines an ear, each ear having a downwardly angled upper edge which defines a camming surface so that said stringers may be snapped into said support plates with said ear camming said sides of said stringers open to receive said lock tab.

14. A support pedestal and stringer subassembly for supporting a plurality of raised access floor panels, said subassembly comprising:

a base adapted to rest on a subfloor;

a support plate on said base; and a plurality of elongated stringers, each of said stringers being generally T-shaped in cross section and including an elongated generally U-shaped leg portion defined by a base and sides, said sides terminating in outwardly extending, generally horizontal flanges, said stringers thereby each defining an elongated slot, said support plate defining a plurality of outwardly opening plate slots, each plate slot dimensioned to receive a leg portion of one of said stringers, and wherein each of said stringers defines a lock aperture and wherein said plates define a plurality of lock tabs, each lock tab extending into one of said plate slots and being received in said lock aperture.

15. A subassembly as defined by claim 14 further comprising a plurality of elongated panel positioners, each positioner including upstanding, parallel, elongated, opposed positioning flanges positioned to engage and locate panels on the stringers and a depending retainer extending into said slot of said stringer for retaining the positioner on said panel.

* * * * *